US006632148B2

(12) United States Patent
Hayashi et al.

(10) Patent No.: US 6,632,148 B2
(45) **Date of Patent: *Oct. 14, 2003**

(54) GOLF BALL

(75) Inventors: Junji Hayashi, Chichibu (JP); Hisashi Yamagishi, Chichibu (JP); Yasumasa Shimizu, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/033,890

(22) Filed: Jan. 3, 2002

(65) Prior Publication Data

US 2002/0155902 A1 Oct. 24, 2002

(30) Foreign Application Priority Data

Jan. 12, 2001 (JP) ..... 2001-005614

(51) Int. Cl.[7] ..... A63B 37/06
(52) U.S. Cl. ..... 473/374; 473/379
(58) Field of Search ..... 473/367, 368, 473/370, 371, 374, 376, 377, 379, 373, 383

(56) References Cited

U.S. PATENT DOCUMENTS 5,249,804 A * 10/1993 Sanchez ..... 473/379
5,830,085 A * 11/1998 Higuchi et al. ..... 473/373
5,902,193 A 5/1999 Shimosaka et al.

FOREIGN PATENT DOCUMENTS

GB 2 355 939 A 5/2001
GB 2 359 998 A 9/2001
JP 9-313643 12/1997
JP 10-305114 11/1998
JP 11-57067 3/1999
JP 11-114094 4/1999
JP 2000-225209 8/2000

OTHER PUBLICATIONS

British Search Report.

* cited by examiner

*Primary Examiner*—Steven Wong
*Assistant Examiner*—Raeann Gorden
(74) *Attorney, Agent, or Firm*—Sughrue Mion, PLLC

(57) ABSTRACT

A golf ball includes a solid core, an intermediate layer, and a cover in a surface of which a plurality of dimples are formed. The solid core has a center JIS-C hardness of 50–70 and a surface JIS-C hardness of 60–80, and has a diameter of 35–40 mm. The intermediate layer is made from a material mainly containing an ionomer resin, and has a JIS-C hardness of 70–85 and a thickness of 0.5–2 mm. The cover is made from a material mainly containing an ionomer resin, and has a JIS-C hardness of 85 or more and a thickness of 0.5–2 mm. A difference in JIS-C hardness between the intermediate layer and the surface of the solid core is in a range of 15 or less. A different in JIS-C hardness between the cover and the intermediate layer is in a range of 10 or more. The hardnesses of the solid core, the intermediate layer, and the cover satisfy a relationship of (hardness gradient from intermediate layer to cover)/(hardness gradient from core center to intermediate layer)≧6. The dimples are arranged such that there is no great circle line not crossing any one of the dimples. The golf ball can exhibit a very soft hitting feel, an excellent durability, a low spin rate and a high hitting angle, and an increased carry due to a high resilience.

6 Claims, 4 Drawing Sheets

GOLF BALL

BACKGROUND OF THE INVENTION

The present invention relates to a golf ball exhibiting a very soft hitting feel, an excellent durability, a low spin rate and a high hitting angle, and an increased carry due to a high resilience.

Golf balls have been variously improved to meet various needs of players, and the present applicant has proposed various excellent golf balls.

For example, Japanese Patent Laid-open No. Hei 9-313643 has disclosed an all-around golf ball having an excellent carrying performance and a high durability, giving a soft hitting feel, and having a good controllability. Japanese Patent Laid-open No. Hei 10-305114 has disclosed a golf ball exhibiting a significantly increased carry and giving a good hitting feel. Japanese Patent Laid-open No. Hei 11-57067 has disclosed a golf ball, which is specified mainly in a relationship between hardnesses of a cover and an intermediate layer and dimples so as to eliminate blow away or drop of the trajectory and hence to increase the carry. Japanese Patent Laid-open No. Hei 11-114094 has disclosed a golf ball, which is specified mainly in a relationship between a deformed amount of a solid core, and thicknesses and hardnesses of a cover and an intermediate layer so as to improve the trajectory upon driver shot and thereby increase the carry, obtain a suitable spin performance upon approach shot, enhance the controllability, and improve the hitting feel and the durability. Japanese Patent Laid-open No. 2000-225209 has disclosed a golf ball, which has a ball structure specified in a relationship among a deformed amount of a solid core, hardnesses of a cover and an intermediate layer, and dimples so as to improve the hitting feel, the durability, and the resilience performance while enhancing the carrying performance, and hence to exhibit excellent performances as a whole.

These golf balls, each of which gives an excellent hitting feel and has a good carrying performance, can desirably meet various needs of players, such as techniques of players and applications of the balls; however, the player's demands against golf balls have come to be further increased, and therefore, it is expected to develop a golf ball with further improved performances.

SUMMARY OF THE INVENTION

An object of the present invention is to provide a golf ball capable of exhibiting a very soft hitting feel, an excellent durability, a low spin rate and a high hitting angle, and an increased carry due to a high resilience.

To achieve the above object, the present inventor has studied a golf ball of a type including a solid core, an intermediate layer, and a cover in a surface of which a plurality of dimples are formed, and found that the golf ball having the following features (1) to (6) can exhibit a very soft hitting feel, an excellent durability, a low spin rate and a high hitting angle, and an increased carry due to a high resilience.

(1) The solid core has a center JIS-C hardness in a range of 50 to 70 and a surface JIS-C hardness in a range of 60 to 80, and has a diameter in a range of 35 to 40 mm.

(2) The intermediate layer is made from a material containing an ionomer resin as a main component, and has a JIS-C hardness in a range of 70 to 85 and a thickness in a range of 0.5 to 2 mm.

(3) The cover is made from a material containing an ionomer resin as a main component, and has a JIS-C hardness in a range of 85 or more and a thickness in a range of 0.5 to 2 mm.

(4) A difference in JIS-C hardness between the intermediate layer and the surface of the solid core (|intermediate layer hardness−solid core surface hardness|) is in a range of 15 or less.

(5) A different in JIS-C hardness between the cover and the intermediate layer (|cover hardness−intermediate layer hardness|) is in a range of 10 or more.

(6) The hardnesses of the solid core, the intermediate layer, and the cover satisfy a relationship of (hardness gradient from intermediate layer to cover)/(hardness gradient from core center to intermediate layer)≧6.

(7) The dimples are arranged in such a manner that there is no great circle line not crossing any one of the dimples.

To be more specific, since both an adhesiveness between the core and the intermediate layer and an adhesiveness between the intermediate layer and the cover are improved, the durability can be enhanced although the core is very soft. Since a dimple arrangement (so-called seamless structure) with no great circle line not crossing any of the dimples is adopted, partial unevenness of the dimples can be eliminated to significantly reduce a variation in carry. Further, there can be realized a ball structure capable of suppressing a side spin, thereby preventing the ball from being flied along a curved trajectory, by combination of the seamless structure with the ball configuration improved to reduce the spin rate. On the basis of the above knowledge, the present invention has been accomplished.

According to an aspect of the present invention, there is provided a golf ball including a solid core, an intermediate layer, and a cover in a surface of which a plurality of dimples are formed, wherein the solid core has a center JIS-C hardness in a range of 50 to 70 and a surface JIS-C hardness in a range of 60 to 80, and has a diameter in a range of 35 to 40 mm; the intermediate layer is made from a material containing an ionomer resin as a main component, and has a JIS-C hardness in a range of 70 to 85 and a thickness in a range of 0.5 to 2 mm; the cover is made from a material containing an ionomer resin as a main component, and has a JIS-C hardness in a range of 85 or more and a thickness in a range of 0.5 to 2 mm; a difference in JIS-C hardness between the intermediate layer and the surface of the solid core (|intermediate layer hardness−solid core surface hardness|) is in a range of 15 or less; a different in JIS-C hardness between the cover and the intermediate layer (|cover hardness−intermediate layer hardness|) is in a range of 10 or more; the hardnesses of the solid core, the intermediate layer, and the cover satisfy a relationship of (hardness gradient from intermediate layer to cover)/(hardness gradient from core center to intermediate layer)≧6; and the dimples are arranged in such a manner that there is no great circle line not crossing any one of the dimples.

The JIS-C hardnesses of the surface of the solid core, the intermediate layer, and the cover preferably satisfy a relationship of (hardness of surface of solid core<hardness of intermediate layer<hardness of cover).

The intermediate layer is preferably made from a material containing, as a main component, a mixture of 50 to 100 mass % of an ionomer resin and 0 to 50 mass % of a thermoplastic elastomer having a crystalline polyethylene block.

The number of kinds of the dimples in terms of shape is preferably in a range of two or more, and the total number of the dimples is in a range of 360 to 460 pieces.

A dimple volume occupying ratio VR (%) is preferably in a range of 0.60 to 1.00%, the dimple volume occupying ratio being defined as a ratio of a total of dimple space volumes under plane surfaces surrounded by edge portions of the dimples to a volume of a virtual ball being the same as the golf ball except that the virtual ball has no dimples, and a dimple surface occupying ratio SR (%) is preferably in a range of 70 to 85%, the dimple surface occupying ratio being defined as a ratio of a total of areas occupied by dimple forming portions to a surface area of the virtual ball.

The arrangement of the dimples is preferably a regular polyhedral arrangement.

The arrangement of the dimples is preferably a regular icosahedral arrangement.

BRIEF DESCRIPTION OF THE DRAWINGS

FIGS. 4A and 4B are views each showing dimples of a golf ball arranged in accordance with an arrangement example of dimples A shown in Table 4, wherein FIG. 4A is a front view and FIG. 4B is a side view;

FIGS. 5A and 5B are views each showing dimples of a golf ball arranged in accordance with an arrangement example of dimples B shown in Table 4, wherein FIG. 5A is a front view and FIG. 5B is a side view;

FIGS. 6A and 6B are views each showing dimples of a golf ball arranged in accordance with an arrangement example of dimples C shown in Table 4, wherein FIG. 6A is a front view and FIG. 6B is a side view;

FIGS. 7A and 7B are views each showing dimples of a golf ball arranged in accordance with an arrangement example of dimples D shown in Table 4, wherein FIG. 7A is a front view and FIG. 7B is a side view.

DETAILED DESCRIPTION OF THE PREFERRED EMBODIMENTS

Figure 1:
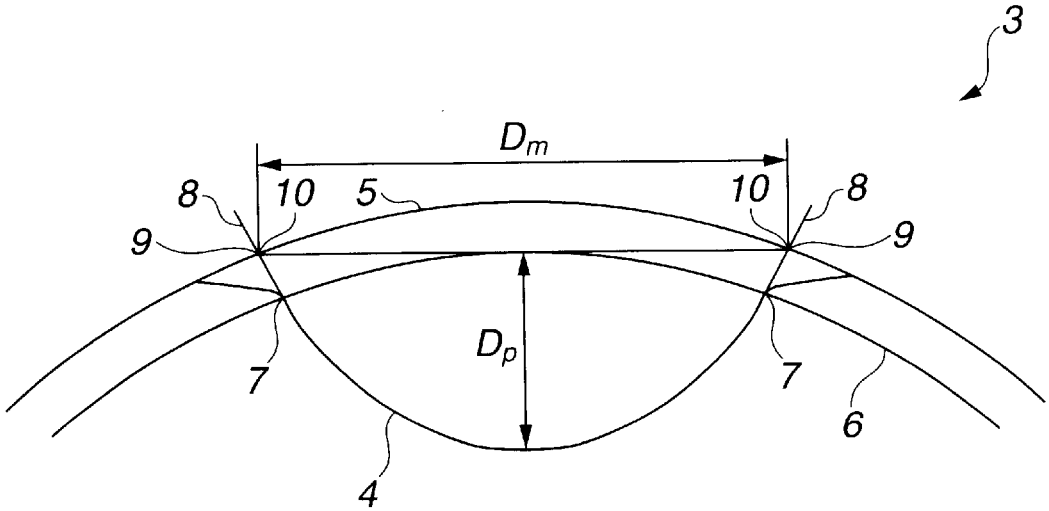
FIG. 1 is an illustrative view for specifying a space volume of each dimple.

The present invention will be hereinafter described in detail. A golf ball of the present invention is a multi-piece golf ball having at least a three layer structure including a solid core, an intermediate layer, and a cover.

The solid core according to the present invention may be made from a known rubber composition. The rubber composition may contain, as a main rubber component, polybutadiene, particularly, cis-1,4-polybutadiene having at least 40% or more of a cis-structure. The main rubber component may be blended with another rubber component such as natural rubber, polyisoprene rubber, or styrene-butadiene rubber.

The rubber composition may contain a crosslinking agent such as a zinc or magnesium salt of an unsaturated fatty acid, for example, zinc methacrylate or zinc acrylate, or an ester compound such as trimethylolpropane trimethacrylate. In particular, zinc acrylate is preferably used because it can impart a high resilience to the solid core. The content of the crosslinking agent may be set, on the basis of 100 parts by mass of the main rubber component, in a range of 10 parts by mass or more, preferably, 15 parts by mass or more, with the upper limit being set in a range of 50 parts by mass or less, preferably, 40 parts by mass or less.

The rubber composition may contain an organic peroxide, for example, 1,1-bis-t-butylperoxy-3,3,5-trimethylcyclohexane, dicumylperoxide, di(t-butylperoxy)-meta-diisopropylbenzene, or 2,5-dimethyl-2,5-di-t-butylperoxyhexane. As the organic peroxide, there can be used a commercial product such as "Percumyl D" (sold by NOF CORPORATION) or "Trigonox" (sold by Kayaku Akzo Corporation). The content of the organic peroxide may be set, on the basis of 100 parts by mass of the main rubber component, in a range of 0.1 part by mass or more, preferably, 0.5 part by mass or more, with the upper limit being set in a range of 5 parts by mass or less, preferably, 2 parts by mass or less.

The rubber composition may further contain various additives such as sulfur, an antioxidant, zinc oxide, barium sulfate, a zinc salt of pentachlorothiophenol, and zinc stearate, as needed. The content of these additives is not particularly limited.

The solid core can be produced in accordance with a known method. For example, the core-forming rubber composition is obtained by kneading the above-described components in a usual mixer such as a Banbury mixer, a kneader, or a roll mill. The resulting compound is molded in a mold by compression molding or the like, to thus obtain a solid core.

According to the present invention, a center hardness, a surface hardness, and a diameter of the solid core are specified to be optimized as follows.

The center hardness of the solid core, expressed in JIS-C hardness, is specified to be in a range of 50 or more, preferably, 55 or more, with the upper limit being set in a range of 70 or less, preferably, 65 or less. If the center hardness of the solid core is excessively low, the resilience is reduced to shorten the carry and also the durability is degraded, while if excessively high, the hitting feel becomes hard.

The surface hardness of the solid core, expressed in JIS-C hardness, is specified to be in a range of 60 or more, preferably, 65 or more, with the upper limit being set in a range of 80 or less, preferably, 75 or less. If the surface hardness of the solid core is excessively low, the resilience is reduced to shorten the carry and also the durability is degraded, while if excessively high, the hitting feel becomes hard.

A difference in JIS-C hardness between the surface of the solid core and the center of the solid core (|core surface hardness−core center hardness|) may be set in a range of 3 or more, preferably, 5 or more, with the upper limit being set in a range of 30 or less, preferably, 25 or less. If the difference in hardness is excessively large or excessively small, it may fail to ensure good hitting feel, resilience, and durability.

According to the present invention, as will be described later, the JIS-C hardness of the solid core is further specified to have an optimized relationship with a JIS-C hardness of each of the intermediate layer and the cover.

The diameter of the solid core is specified to be in a range of 35 mm or more, preferably, 35.5 mm or more, with the upper limit being set in a range of 40 mm or less, preferably, 39 mm or less. If the diameter is excessively large, the cover and intermediate layer become relatively thin, the resilience and durability may be degraded, while if excessively small, the cover and intermediate layer become relatively thick, the ball becomes hard as a whole, and thereby the hitting feel is degraded.

The weight of the solid core is not particularly limited but may be set in a range of 25 g or more, preferably, 27 g or more, with the upper limit being set in a range of 40 g or less, preferably, 38 g or less.

The intermediate layer according to the present invention is specified as being made from a material containing an ionomer resin as a main component in order to ensure an excellent adhesiveness with the cover to be described later. If the content of the ionomer resin is excessively small, the adhesiveness with the cover is reduced, with a result that the durability and the resilience may be degraded. The wording "main component" used here means that the intermediate layer material contains the main component in an amount of 50 mass % or more.

As the ionomer resin for forming the intermediate layer, there can be used a commercial product, for example, "Himilan" (ionomer resin sold by Du Pont Mitsui Polychemicals Co., Ltd.), "Surlyn" (ionomer resin sold by Du Pont DE NEMOURS & COMPANY, USA), or "Iotek" (ionomer resin sold by Exxon Chemical Japan Ltd.).

The material for forming the intermediate layer may contain, in addition to the ionomer resin as the main component, another component selected from a thermoplastic elastomer having a crystalline polyethylene block, a polyester based thermoplastic elastomer, a polyamide based thermoplastic elastomer, a polyurethane based thermoplastic elastomer, an olefin based thermoplastic elastomer, a styrene based thermoplastic elastomer, and mixtures thereof. In particular, the thermoplastic elastomer having a crystalline polyethylene block is preferably used.

The thermoplastic elastomer having a crystalline polyethylene block preferably has a polyethylene crystalline block (E) or polyethylene crystalline block (E) and a polystyrene crystalline block (S) as a hard segment, and a relatively random copolymer structure (EB) composed of ethylene and butylene as a soft segment. In particular, a block copolymer having a molecular structure having the hard segment at one terminal or each of both terminals of the soft segment, for example, an E-EB, E-EB-E, or E-EB-S type block copolymer is preferably used.

Such a thermoplastic elastomer can be obtained by hydrogenating polybutadiene or styrene-butadiene copolymer.

For polybutadiene or styrene-butadiene copolymer to be hydrogenated, there is preferably used butadiene having a 1,4-polymer block containing 95 to 100 mass % of 1,4-bonds, wherein the content of the 1,4-bonds in the total amount of a butadiene structure is 50 to 100 mass %, preferably, 80 to 100 mass %. In particular, an elastomer obtained by hydrogenating polybutadiene, in which 1,4-bond rich 1,4-polymers are sited at both terminals of a molecular chain and 1,4-bonds and 1,2-bonds are mixed at an intermediate portion of the molecular chain, is suitable as the E-EB-E type thermoplastic elastomer. An added amount of hydrogen in an elastomer, which is obtained by hydrogenating polybutadiene or styrene-butadiene copolymer, is preferably set in a range of 60 to 100%, more preferably, 90 to 100%. It is to be noted that the added amount of hydrogen is equivalent to a conversion ratio of double bonds to saturated bonds in polybutadiene or styrene-butadiene copolymer. If the added amount of hydrogen is excessively low, there may occur a deterioration such as gelling in the step of blending the elastomer with the ionomer resin, or there may occur a problem associated with hitting durability of the intermediate layer.

The hard segment amount in the thermoplastic elastomer may be set in a range of 10 to 50 mass %. If the hard segment amount is excessively large, and the flexibility is poor, thereby it may often fail to effectively achieve the object of the present invention, while if excessively small, there may occur a problem associated with moldability of a blend of the thermoplastic elastomer and the ionomer resin.

A melt index at 230° C. of the thermoplastic elastomer may be set in a range of 0.01 to 15 g/10 min, preferably, 0.03 to 10 g/10 min from the viewpoint of preventing a failure upon injection molding, such as weld, shrinkage, or shortage.

A surface hardness of the thermoplastic elastomer, expressed in Shore D hardness, is preferably set in a range of 10 to 50. If the surface hardness is excessively low, since the amount of polyethylene crystal at a terminal of the thermoplastic elastomer is small, the compatibility of the thermoplastic elastomer with the ionomer resin to be blended therewith is lowered, so that the durability against repeated hitting of a product ball may be degraded. If the surface hardness is higher than 50, the resilience of the thermoplastic elastomer is reduced, and thereby the resilience of a blend of the thermoplastic elastomer and the ionomer resin may be reduced.

A number-average molecular weight of the thermoplastic elastomer is preferably set in a range of 30,000 to 800,000.

As the thermoplastic elastomer having such a crystalline ethylene block, there may be used a commercial product such as "Dynalon E6100", "Dynalon HSB604", or "Dynalon E4600P" sold by Japan Synthetic Rubber Co., Ltd. These thermoplastic elastomers may be used individualy or in combination of two kinds or more. In particular, "Dynalon E6100P", which is a block polymer having crystalline olefin blocks at both terminals, is preferably used.

A melt index at 190° C. of the ionomer resin to be blended with the thermoplastic elastomer having a crystalline polyethylene block may be set in a range of 1.0 g/10 min or more, preferably, 1.5 g/10 min or more, with the upper limit being set in a range of 20 g/10 min or less, preferably, 15 g/10 min or less. If the melt index is excessively low, a melt flowability of the intermediate layer material becomes excessively low, so that the resin is not allowed to sufficiently run in a mold upon molding. As a result, there may often occur a molding failure such as weld, shrinkage, or shortage in the intermediate layer.

According to the present invention, if the blend of the ionomer resin as a main component and the thermoplastic elastomer having a crystalline polyethylene block is used as a material for forming the intermediate layer, the content of the ionomer resin may be set, on the basis of 100 mass % of the blend, in a range of 50 mass % or more, preferably, 55 mass % or more, with the upper limit being set in a range of 100 mass % or less, preferably, 95 mass % or less, and the content of the thermoplastic elastomer having a crystalline polyethylene block may be set, on the basis of 100 mass % of the blend, in a range of 0 mass % or more, preferably, 5 mass % or more, with the upper limit being set in a range of 50 mass % or less, preferably, 45 mass % or less. If the content of each of the components is out of the above range, the moldability may be lowered or the durability may be degraded.

The intermediate layer can be produced in accordance with a known method such as an injection or compression molding process. For example, in the case of adopting the injection molding process, a solid core previously prepared is set in a mold, and the intermediate layer material is injection-molded in the mold in accordance with a usual manner.

According to the present invention, a JIS-C hardness and a thickness of the intermediate layer are specified to be optimized as follows.

The JIS-C hardness of the intermediate layer is specified to be in a range of 70 or more, preferably, 71 or more, with the upper limit being set in a range of 85 or less, preferably, 84 or less. The hardness of the intermediate layer can be determined by measuring a hardness of a sheet-like test piece molded from the intermediate layer material. If the JIS-C hardness is excessively low, the resilience may be reduced to shorten the carry of the ball, while if excessively high, the hitting feel becomes hard, and the durability may be degraded because a difference in hardness between the intermediate layer and the core surface becomes large.

A thickness of the intermediate layer is specified to be in a range of 0.5 mm or more, preferably, 0.6 mm or more, with the upper limit being set in a range of 2 mm or less, preferably, 1.9 mm or less. If the intermediate layer is excessively thin, the durability may be degraded, while if excessively thick, the hitting feel may become hard or the resilience may be reduced.

According to the present invention, as will be described later, the JIS-C hardness of the intermediate layer is specified to have an optimized relationship with the surface hardness of the solid core and to have a specific hardness distribution.

The cover according to the present invention is specified as being made from a material containing an ionomer resin as a main component in order to ensure an excellent adhesiveness with the intermediate layer. The wording "main component" used here means that the cover material contains the main component in an amount of 50 mass % or more.

As the ionomer resin for the intermediate layer, there can be used a commercial product, for example, "Himilan" (ionomer resin sold by Du Pont Mitsui Polychemicals Co., Ltd.), "Surlyn" (ionomer resin sold by Du Pont DE NEMOURS & COMPANY, USA), or "Iotek" (ionomer resin sold by Exxon Chemical Japan LTD.).

Various additives such as a UV absorbent, an oxidation inhibitor, a metal soap, a pigment, and an inorganic filler may be added to the cover material in suitable amounts.

Using the cover material, a golf ball of the present invention can be produced in accordance with a known method such as an injection or compression molding process. For example, in the case of adopting the injection molding process, a solid core around which an intermediate layer has been formed is set in a mold, and the cover material is injection-molded in the mold in accordance with a usual manner.

A thickness of the cover is specified to be in a range of 0.5 mm or more, preferably, 0.6 mm or more, with the upper limit being set in a range of 2 mm or less, preferably, 1.9 mm or less. If the cover is excessively thin, the resilience may be reduced and the durability may be degraded, while if excessively thick, the hitting feel becomes hard.

A JIS-C hardness of the cover is specified to be in a range of 85 or more, preferably, 87 or more. If the JIS-C hardness is excessively low, the resilience is reduced, and further the carry of the ball is shortened because a spin rate upon hitting with a driver becomes large. The upper limit of the JIS-C hardness of the cover may be set in a range of 100 or less, preferably, 98 or less. If excessively high, the hitting feel may become hard.

The golf ball of the present invention is specified such that not only the JIS-C hardness of each of the solid core surface, the intermediate layer, and the cover is optimized, but also both a difference in JIS-C hardness between the solid core surface and the intermediate layer and a difference in JIS-C hardness between the intermediate layer and the cover are optimized. To be more specific, according to the present invention, to impart good resilience, durability, and hitting feel, the difference in JIS-C hardness between the intermediate layer and the solid core surface (|intermediate layer hardness−solid core surface hardness|) is required to be in a range of 15 or less, preferably, 14 or less, and also the difference in JIS-C hardness between the cover and the intermediate layer (|cover hardness−intermediate layer hardness|) is required to be 10 or less, preferably, 11 or less. If each difference in hardness is out of the above range, the hitting feel becomes hard, the resilience is reduced, and the durability is degraded. In addition, to ensure good hitting feel, resilience, and durability, the lower limit of the difference in JIS-C hardness between the intermediate layer and the solid core surface may be set in a range of 0 or more, preferably, 2 or more, and the upper limit of the difference in JIS-C hardness between the cover and the intermediate layer may be set in a range of 30 or less, preferably, 25 or less.

The JIS-C hardness of each of the solid core surface, the intermediate layer, and the cover may become higher in this order, that is, in the order of (hardness of solid surface<hardness of intermediate layer<hardness of cover). With this adjustment of hardness, it is possible to reduce an energy loss, and hence to further improve the resilience.

The hardness distribution of the golf ball of the present invention is specified such that a hardness gradient ratio, expressed by (hardness gradient between intermediate layer to cover)/(hardness gradient from core center to intermediate layer), is in a range of 6 or more, preferably, 7 or more. If the hardness gradient ratio is excessively small, it fails to ensure a low spin rate, a high hitting angle, and a high resilience.

According to the present invention, the hardness gradient from the intermediate layer to the cover means a hardness gradient calculated on the basis of the hardness of the intermediate layer and the hardness of the cover, and the hardness gradient from the core center to the intermediate layer means a hardness gradient calculated on the basis of the hardness of the intermediate layer and the hardness of the core center. Such a hardness gradient can be calculated on the basis of the following equations:

Hardness Gradient from Intermediate Layer to Cover=(|Difference in Hardness between Cover and Intermediate Layer|/(Cover Gage)

Hardness Gradient from Core Center to Intermediate Layer=(|Difference in Hardness between Intermediate Layer and Core Center|)/(Distance from Core Center to Surface of Intermediate Layer)

The golf ball of the present invention includes a plurality of dimples in a cover surface. According to the present invention, these dimples are specified as being arranged with no great circle line not crossing any one of the dimples. The presence of the great circle line not crossing the dimples causes a variation in carry of the ball.

The number of kinds of the dimples and the total number of the dimples are preferably optimized. By the combination of the optimization of the number of kinds of the dimples with the optimization of the total number of the dimples, the golf ball can exhibit a more stable trajectory and an excellent carrying performance.

The wording "the number of kinds of the dimples" means the number of kinds of the dimples different from each other in terms of diameter and/or depth. The number of kinds of the dimples may be set in a range of 2 or more, preferably, 3 or more, with the upper limit being set in a range of 8 or less, preferably, 6 or less.

The total number of the dimples may be set in a range of 360 or more, preferably, 365 or more, with the upper limit being set in a range of 460 or less, preferably, 455 or less. If the total number of the dimples is excessively large or small, the carry of the ball may be shortened because an optimum lift cannot be obtained.

According to the golf ball of the present invention, a dimple volume occupying ratio VR (%) and a dimple surface occupying ratio SR (%) may be optimized. By the combination of the optimization of the SR with the optimization of the VR, the trajectory of the ball can be optimized to improve the carry of the ball, and also the balance between a lift and a drag can be optimized to enhance the carrying performance.

The dimple volume occupying ratio VR is defined as a ratio (%) of a total of dimple space volumes $V_p$ under plane surfaces surrounded by edge portions of the dimples to a volume of a virtual ball being the same as the golf ball except that the virtual ball has no dimples.

The dimple volume occupying ratio VR can be calculated on the basis of the following equation:

$$VR = \frac{V_s}{\frac{4}{3}\pi R^3} \times 100 \tag{1}$$

where $V_s$ is the total of dimple space volumes $V_p$ under a plane surface surrounded by edge portions of the dimples, and R is a radius of the virtual ball.

In addition, $V_s$ in the equation (1) is a value expressed by the following equation;

$$V_s = N_1 V_{P1} + N_2 V_{P2} + \cdots + N_n V_{Pn} = \sum_{i=1}^{n} N_i V_{Pi} \tag{2}$$

where $V_{p1}$, $V_{p2}$, . . . $V_{pn}$ are volumes of the dimples different from each other in shape; $N_1$, $N_2$, . . . $N_n$ are the numbers of the dimples having the volumes of $V_{p1}$, $V_{p2}$, . . . $V_{pn}$; and n is an integer of 1 or more.

The value VR can be calculated by substituting the value $V_s$ thus obtained in the equation (1).

Figure 2:
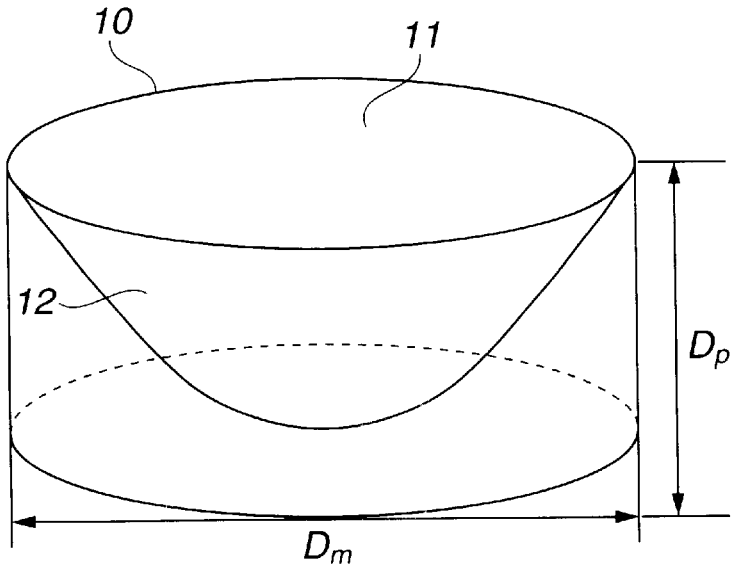
FIG. 2 is a perspective view of the dimple shown in FIG. 1.
Figure 3:
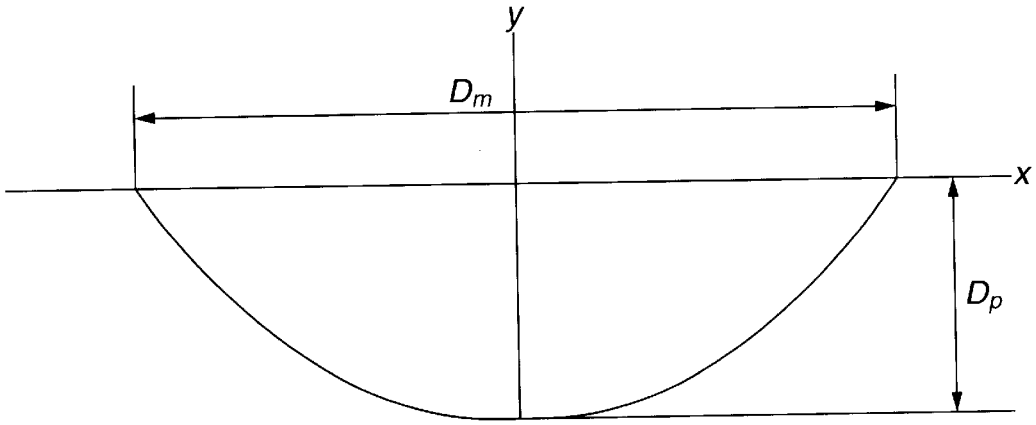
FIG. 3 is a sectional view of the dimple shown in FIG. 1.
Figure 4A:
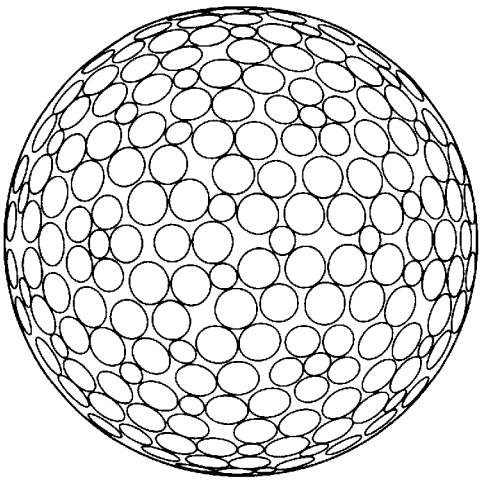
Figure 4B:
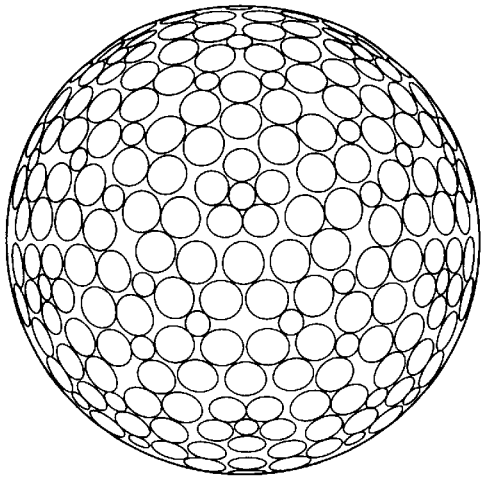
Figure 5A:
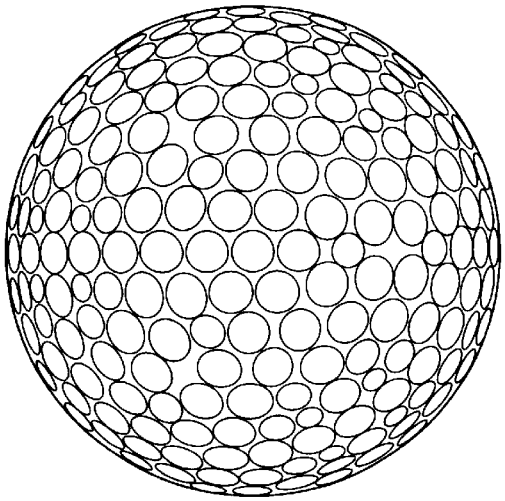
Figure 5B:
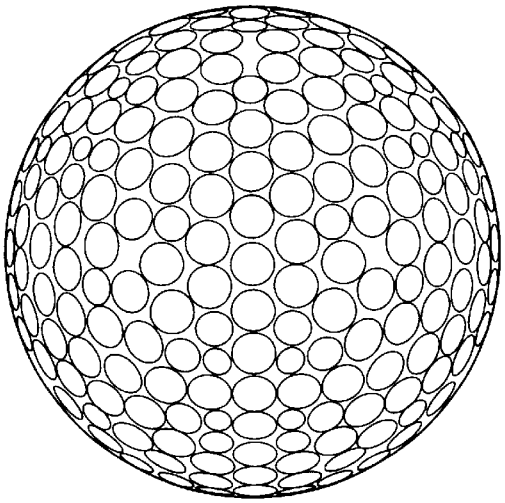
Figure 6A:
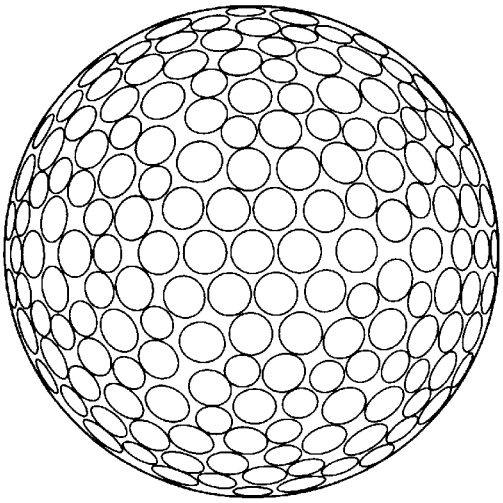
Figure 6B:
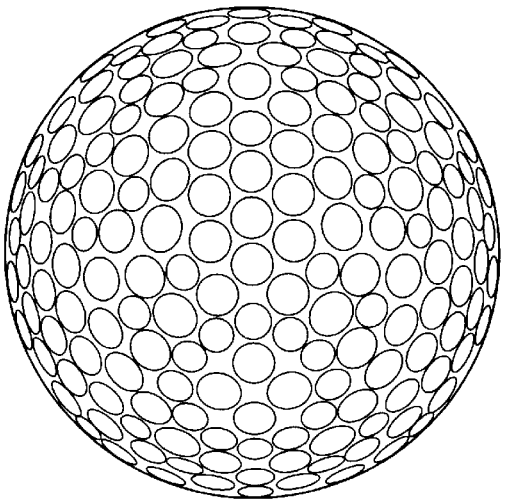
Figure 7A:
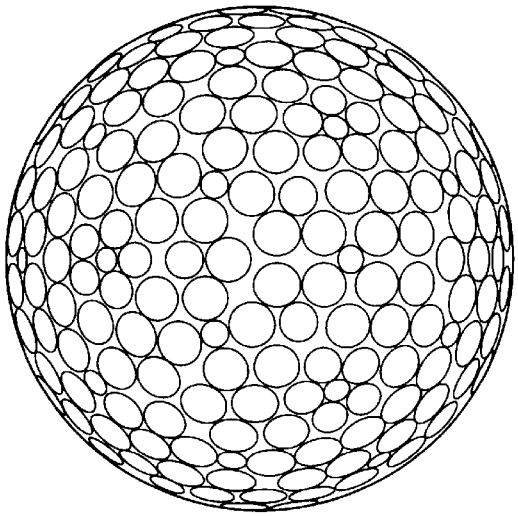
Figure 7B:
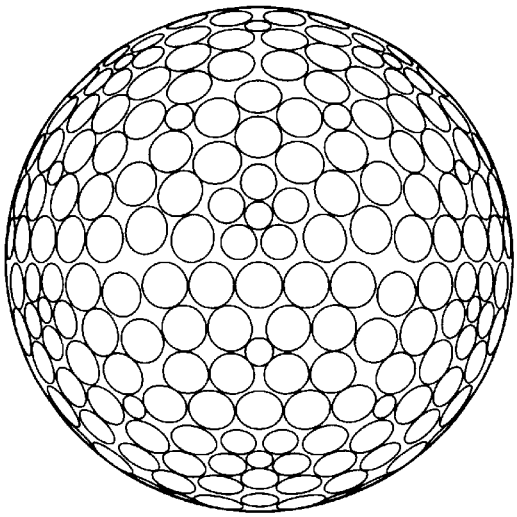
Figure 8:
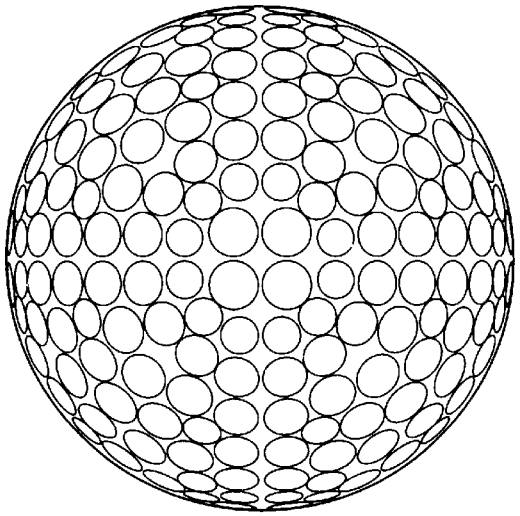
FIG. 8 is a front view showing dimples of a golf ball arranged in accordance with an arrangement example of dimples E shown in Table 4.

The calculation of each of the dimple space volumes $V_p$ will be described below. Assuming that the plane shape of each dimple is a circular shape, as shown in FIG. 1, a virtual spherical plane 5 having the same diameter as that of the golf ball is set on the dimple 4 and also a spherical plane 6 having a diameter smaller than the diameter of the golf ball by 0.16 mm is set on the dimple 4. In this case, tangential lines 8 at crossing points 7 between the circumference of the spherical plane 6 and the dimple 4 cross the virtual spherical plane 5 at crossing points 10. The crossing points 10, which are continuous to each other, are taken as a dimple edge portion 10. The reason why the dimple edge portion 10 is thus set is that since the edge portion of the dimple 4 is generally rounded, an accurate position of the edge portion of the dimple 4 cannot be determined unless set as described above. As shown in FIGS. 2 and 3, the volume $V_p$ of each dimple space 12 is calculated by using a diameter $D_m$ of a plane surface 11 surrounded by the dimple edge portion 10 and a distance (dimple depth) $D_p$ from the plane surface 11 to the bottom of the dimple 4. If the dimples are of one kind, the volume $V_p$ is multiplied by the total number of the dimples, and if the dimples are of two or more kinds, the volume $V_p$ for each kind is multiplied by the total number of the dimples of each kind. In each case, the calculated result is substituted in the equation (2), to obtain the total dimple space volume $V_s$, and then the total dimple space volume $V_s$ is substituted in the equation (1), to obtain the dimple volume occupying ratio VR.

According to the present invention, the dimple volume occupying ratio VR (%) may be set in a range of 0.60% or more, preferably, 0.62% or more, with the upper limit being set in a range of 1.00% or less, preferably, 0.98% or less. If the value VR is excessively small, the ball may be blown away to shorten the carry of the ball, while if excessively large, the trajectory may be excessively low to shorten the carry of the ball.

According to the golf ball of the present invention, in addition to the optimization of the value VR, a dimple surface occupying ratio SR is also specified as being optimized. The dimple surface occupying ratio SR is defined as a ratio (%) of a total of surface areas of portions, surrounded by the dimple edge portions, of the spherical plane of a virtual ball being the same as the golf ball except that the virtual ball has no dimples to the surface area of the virtual ball. Referring to FIG. 1, each dimple area is defined as an area of a portion, surrounded by the dimple edge portion 10, of the virtual spherical plane 5. According to the present invention, the value SR may be set in a range of 70% or more, preferably, 71% or more, with the upper limit being set in a range of 85% or less, preferably, 84% or less. if the value SR is excessively large or small, an optimum lift cannot be obtain, tending to shorten the carry of the ball.

The dimple volume occupying ratio VR and the dimple surface occupying ratio SR are measured for dimples of a product golf ball. For example, in the case where after the cover is formed, the ball surface is subjected to finishing treatments such as paining and stamping, the values VR and SR are measured for dimples of a product golf ball which has been subjected to the above final treatments.

According to the present invention, as described above, the dimples are specified as being arranged such that there is no great circle line not crossing any one of the dimples. In addition to this, to optimize the trajectory and improve the carry, the arrangement of the dimples may be a regular polyhedral arrangement, preferably, a regular icosahedral arrangement.

It is to be noted that, like a known golf ball, the golf ball of the present invention may be suitably subjected to various finishing treatments such as paining and stamping.

The golf ball of the present invention can be formed to have a diameter of 42.67 mm or more and a weight of 45.93 g or less in accordance with the Rules of Golf.

The golf ball of the present invention can exhibit a very soft hitting feel, an excellent durability, a low spin rate and a high hitting angle, and an increased carry due to a high resilience.

EXAMPLE

The present invention will be more fully understood by way of, while not limited thereto, the following examples and comparative examples.

Examples 1 to 4 and Comparative Examples 1 to 3

Each of core-forming rubber compositions 1 to 6 shown in Table 1 was molded in a special mold in accordance with a usual manner, to produce a solid core.

Each of intermediate layer materials having compositions "a", "b", "e", and "f" shown in Table 2 and each of cover materials having compositions "c", "d" shown in Table 2 were sequentially injection-molded around the solid core thus obtained. The combinations of the core materials, the intermediate layer materials, and the cover materials are as shown in Table 4. In this way, a golf ball having each of dimple arrangements shown in Table 3 was produced. It is to be noted that the dimple arrangements are concretely shown in FIGS. 4 to 8.

In Table 2, a UV absorbent, an oxidation inhibitor, a dispersant, a coloring agent, and the like are suitably added to each material. Further, the commercial products used for the intermediate layer and the cover, shown in Table 2, are as follows:

"Himilan": ionomer resin sold by Du Pont Mitsui Polychemicals Co., Ltd.

"Nucrel": ethylene-methacrylic acid copolymer sold by Du Pont Mitsui Polychemicals Co., Ltd.

"Surlyn": ionomer resin sold by Du Pont DE NEMOURS & COMPANY, USA.

"Dynalon": E-EB-E type hydrogenated block copolymer-polybutadiene sold by Japan Synthetic Rubber Co., Ltd.

The main terms described in Tables 3 and 4 are as follows:

SR

A dimple surface occupying ratio SR is a ratio (%) of a total of surface areas of portions, surrounded by dimple edge portions, of a spherical plane of a virtual ball being the same as a golf ball except that the virtual ball has no dimples to a total surface area of the virtual ball.

VR

A dimple volume occupying ratio is a ratio of a total of dimple space volumes under plane surfaces, surrounded by edge portions of dimples to a total volume of a virtual ball being the same as a golf ball except that the virtual ball has no dimples.

Core Hardness

A core hardness was obtained by directly measuring a hardness of a core using a JIS-C hardness meter. A center hardness of the core was obtained by cutting the core into halves and measuring a hardness of a center portion of the core half.

Hardness of Each of Intermediate Layer and Cover

A hardness of each of an intermediate layer and a cover was obtained by preparing a sheet-like test piece from each of an intermediate layer material and a cover material and measuring a hardness of the test piece in accordance with a JIS-C hardness measuring method.

Diameter of Each of Intermediate Layer and Cover

A diameter of each of an intermediate layer and a cover was obtained as an average value of diameters measured at arbitrary five points on a surface of each of the intermediate layer and the cover.

Outer Diameter of Product

An outer diameter of a product ball was obtained as an average value of outer diameters measured at arbitrary five points on land portions with no dimples of the product ball.

Thickness of Cover

A thickness of a cover was calculated on the basis of an equation of (diameter of product—diameter of solid core covered with intermediate layer)/2.

(Hardness Gradient Between Intermediate layer and Cover)/(Hardness Gradient Between Core Center and Intermediate Layer)

Hardness Gradient from Intermediate Layer to Cover=(|Difference in Hardness between Cover and Intermediate Layer|/(Cover Gage)

Hardness Gradient from Core Center to Intermediate Layer=(|Difference in Hardness between Intermediate Layer and Core Center|)/(Distance from Core Center to Surface of Intermediate Layer)

Carrying Performance

Using a swing robot (Miyamae Co. Ltd.), the golf ball was hit with a driver (W#1) at a head speed of 45 m/s, and the spin rate, the hitting angle, the total carry, and the lateral deviation were measured. The lateral deviation was measured as follows: namely, 30 pieces of the golf balls of each kind were hit under the same condition, and a deviation between the leftmost drop point and the rightmost drop point of the balls with respect to the hitting position was measured.

Durability

Using the same swing robot as that used for testing the carrying performance, the same golf ball was repeatedly hit with a driver (W#1) at a head speed of 40 m/s until the golf ball was cracked. The test was performed for a usual three-piece golf ball ("ALUTUS NEWING" sold by Bridgestone Sports Co., Ltd.) as a comparative golf ball. The durability of each golf ball was evaluated under the following criterion:

○: superior to comparative golf ball

X: inferior to comparative golf ball

Hitting Feel

Each golf ball was hit with a driver (W#1) by five professional golfers, and the hitting feel was evaluated on the basis of majority rule in accordance with the following criterion:

○: soft

Δ: medium

X: hard

TABLE 1

| Composition (parts by mass) | 1 | 2 | 3 | 4 | 5 | 6 |
|---|---|---|---|---|---|---|
| 1,4-polybutadiene (cis-structure) | 100 | 100 | 100 | 100 | 100 | 100 |
| Zinc acrylate | 26.6 | 25.4 | 24.6 | 24.1 | 22.5 | 22.3 |
| Dicumyl peroxide | 1.2 | 1.2 | 1.2 | 1.2 | 1.2 | 1.2 |
| Antioxidant | 0.1 | 0.1 | 0.1 | 0.1 | 0.1 | 0.2 |
| Zinc oxide | 28.5 | 29.0 | 29.3 | 30.0 | 30.1 | 24.0 |
| Zinc salt of pentachlorothiophenol | 1.0 | 1.0 | 1.0 | 0.2 | 1.0 | 0.1 |

TABLE 2

| Composition (mass %) | a | b | c | d | e | f |
|---|---|---|---|---|---|---|
| Himilan 7930 | 23 | | | | | |
| Himilan 7311 | 21 | | | | | |
| Nucrel AN4318 | 26 | | | | | |
| Dynalon 6100P | 30 | 30 | | | | |
| Surlyn 9650 | | 35 | | | | |
| Surlyn 8660 | | 35 | | | | |
| Himilan 1605 | | | 50 | | | |
| Himilan 1706 | | | 50 | | | |
| Himilan 1601 | | | | 50 | | |
| Himilan 1557 | | | | 50 | | |
| Surlyn 7930 | | | | | 60 | |
| Surlyn AD8542 | | | | | 35 | |
| Nucrel 9-1 | | | | | 5 | |
| Hytrel 4047 | | | | | | 100 |

TABLE 3

| Kinds of Dimples | | A | B | C | D | E |
|---|---|---|---|---|---|---|
| Number of great circle lines not crossing dimples | | 0 | 0 | 0 | 1 | 3 |
| Total number | | 432 | 398 | 392 | 396 | 368 |
| VR (%) | | 0.81 | 0.92 | 0.87 | 0.86 | 0.89 |
| SR (%) | | 78.6 | 74.5 | 77.7 | 74.8 | 73.3 |
| Arrangement | | Regular icosahedron | Regular octahedron | Regular octahedron | — | Regular octahedron |
| Kinds of dimples different in diameter and depth | | 3 | 4 | 3 | 4 | 4 |
| Dimple 1 | Diameter(mm) | 3.9 | 4.1 | 4.1 | 4.0 | 4.3 |
| | Depth(mm) | 0.16 | 0.19 | 0.17 | 0.17 | 0.20 |
| | Total number | 300 | 48 | 72 | 276 | 56 |
| Dimple 2 | Diameter(mm) | 3.4 | 3.8 | 3.9 | 3.6 | 4.0 |
| | Depth(mm) | 0.13 | 0.18 | 0.16 | 0.15 | 0.19 |
| | Total number | 60 | 254 | 200 | 24 | 120 |
| Dimple 3 | Diameter(mm) | 2.6 | 3.2 | 3.4 | 3.2 | 3.9 |
| | Depth(mm) | 0.10 | 0.16 | 0.14 | 0.14 | 0.18 |
| | Total number | 72 | 72 | 120 | 60 | 96 |
| Dimple 4 | Diameter(mm) | — | 2.4 | — | 2.4 | 3.1 |
| | Depth(mm) | — | 0.12 | — | 0.11 | 0.15 |
| | Total number | — | 24 | — | 36 | 96 |

TABLE 4

| | Example | | | | Comparative Example | | |
|---|---|---|---|---|---|---|---|
| | 1 | 2 | 3 | 4 | 1 | 2 | 3 |
| Core | | | | | | | |
| Diameter(mm) | 36.4 | 36.4 | 36.4 | 36.4 | 36.4 | 36.4 | 35.3 |
| Weight(g) | 30.7 | 30.7 | 30.7 | 30.7 | 30.7 | 30.7 | 26.9 |
| Center JIS-C hardness | 59.0 | 56.9 | 59.0 | 55.9 | 59.5 | 53.5 | 60.0 |
| Surface JIS-C hardness | 73.0 | 68.6 | 73.0 | 66.3 | 75.0 | 60.5 | 75.0 |
| Composition | 1 | 2 | 1 | 3 | 4 | 5 | 6 |
| Intermediate layer | | | | | | | |
| Thickness(mm) | 1.7 | 1.7 | 1.7 | 1.7 | 1.7 | 1.7 | 1.8 |
| JIS-C hardness | 77.6 | 77.6 | 77.6 | 80.3 | 84.2 | 84.2 | 63.2 |
| Difference in hardness with core surface | 4.6 | 9.0 | 4.6 | 14.0 | 9.2 | 23.7 | −11.8 |
| Material | a | a | a | b | e | e | f |
| Cover | | | | | | | |
| Thickness(mm) | 1.45 | 1.45 | 1.45 | 1.45 | 1.45 | 1.45 | 1.9 |
| JIS-C hardness | 93.4 | 93.4 | 89.5 | 93.4 | 89.5 | 89.5 | 93.4 |
| Difference in hardness with intermediate layer | 15.8 | 15.8 | 11.9 | 13.1 | 5.3 | 5.3 | 30.2 |
| Material | c | c | d | c | d | d | c |
| (hardness gradient between intermediate layer and cover)/(hardness gradient between core center and intermediate layer) | 11.7 | 10.5 | 8.8 | 7.4 | 2.9 | 2.4 | 98.0 |
| Dimple | A | B | A | C | D | D | E |
| Product | | | | | | | |
| Diameter(mm) | 42.7 | 42.7 | 42.7 | 42.7 | 42.7 | 42.7 | 42.7 |
| Weight(g) | 45.2 | 45.2 | 45.2 | 45.2 | 45.2 | 45.2 | 45.2 |
| Carrying performance | | | | | | | |
| Spin(rpm) | 2870 | 2850 | 2860 | 2840 | 3000 | 2850 | 2980 |
| Hitting angle(°) | 12.6 | 12.7 | 12.6 | 12.7 | 12.1 | 12.6 | 12.2 |
| Carry(m) | 217.5 | 217.0 | 216.5 | 217.0 | 214.5 | 215.0 | 215.0 |
| Lateral deviation(m) | 17.5 | 17.0 | 18.0 | 17.0 | 20.5 | 20.0 | 19.5 |
| Durability | ○ | ○ | ○ | ○ | ○ | x | x |
| Hitting Feel | ○ | ○ | ○ | ○ | x | ○ | Δ |

As is apparent from Table 4, it is revealed that each of the golf balls in Examples 1 and 4 exhibits a very soft hitting feel, an excellent durability, a low spin rate and a high hitting angle, and an increased carry due to a high resilience.

On the contrary, the golf ball in Comparative Example 1, which is equivalent to a three-piece golf ball of a type described in Japanese Patent Laid-open No. 9-313643, exhibits a variation in carry and is short in carry, and also gives a hard hitting feel. This is because the core is hard and a difference in hardness between two of the core, the intermediate layer, and the cover is small, that is, the ball has not a "low spin and high resilience" structure, and further, there is the great circle line not crossing the dimples.

The golf ball in Comparative Example 2, which is equivalent to a three-piece golf ball of a type described in Japanese Patent Laid-open No. Hei 10-305114, gives a soft hitting feel because the core is very soft, but is poor in durability and resilience because a difference in hardness between the core and the intermediate layer being less in adhesiveness with the core is excessively large. The golf ball further exhibits a variation in carry and is short in carry because there is the great circle line not crossing the dimples.

The golf ball in Comparative Example 3, which is equivalent to a three-piece golf ball of a type described in Japanese Patent No. 2658811, is poor in durability and resilience because the intermediate layer is soft and is made from a material (polyester) different from that of the cover. The golf ball also exhibits an increased spin rate upon hitting with a driver because the intermediate layer is soft and thereby the core is correspondingly hard. The golf ball further exhibits a variation in carry and is short in carry because there is the great circle lines not crossing the dimples in addition to the above-described properties.

While the preferred embodiments of the present invention have been described using specific terms, such description is for illustrative purposes only, and it is to be understood that changes and variations may be made without departing from the spirit or scope of the following claims.

What is claimed is:

1. A golf ball comprising a solid core, an intermediate layer, and a cover in a surface of which a plurality of dimples are formed, wherein said solid core has a center JIS-C hardness in a range of 50 to 70 and a surface JIS-C hardness in a range of 60 to 80, and has a diameter in a range of 35 to 40 mm, said intermediate layer is made from a material containing an ionomer resin as a main component, and has a JIS-C hardness in a range of 70 to 85 and a thickness in a range of 0.5 to 2 mm, said cover is made from a material containing an ionomer resin as a main component, and has a JIS-C hardness in a range of 85 or more and a thickness in a range of 0.5 to 2 mm, a difference in JIS-C hardness between said intermediate layer and the surface of said solid core (|intermediate layer hardness−solid core surface hardness|) is in a range of 15 or less, a difference in JIS-C hardness between said cover and said intermediate layer (|cover hardness−intermediate layer hardness|) is in a range of 10 or more, the hardnesses of said solid core, said intermediate layer, and said cover satisfy a relationship of (hardness gradient from intermediate layer to cover)/(hardness gradient from core center to intermediate layer)≧6, said dimples are arranged in such a manner that there is no great circle line not crossing any one of said dimples;

wherein a dimple volume occupying ratio VR (%) is in a range of 0.60 to 1.00%, said dimple volume occupying ratio being defined as a ratio of a total of dimple space volumes under plane surfaces surrounded by edge portions of said dimples to a volume of a virtual ball being the same as said golf ball except that said virtual ball has no dimples, and a dimple surface occupying ratio SR (%) is in a range of 70 to 85%, said dimple surface occupying ratio being defined as a ratio of a total of areas occupied by dimple forming portions to a surface area of said virtual ball.

2. A golf ball according to claim 1, wherein the JIS-C hardnesses of the surface of said solid core, said intermediate layer, and said cover satisfy a relationship of (hardness of surface of solid core<hardness of intermediate layer<hardness of cover).

3. A golf ball according to claim 1, wherein said intermediate layer is made from a material containing, as a main component, a mixture of 50 to 100 mass % of an ionomer resin and 0 to 50 mass % of a thermoplastic elastomer having a crystalline polyethylene block.

4. A golf ball according to claim 1, wherein the number of kinds of said dimples is in a range of two or more, and the total number of said dimples is in a range of 360 to 460 pieces.

5. A golf ball according to claim 1, wherein the arrangement of said dimples is a regular polyhedral arrangement.

6. A golf ball according to claim 5, wherein the arrangement of said dimples is a regular icosahedral arrangement.

* * * * *